US008418328B2

(12) United States Patent
Gürel et al.

(10) Patent No.: US 8,418,328 B2
(45) Date of Patent: Apr. 16, 2013

(54) ELLIPTICAL-SECTIONED DRUM SYSTEM WITH HELICAL EXPANDER

(75) Inventors: Hakan Gürel, ç orlu/Tekirda (TR); Ömer Gökcan, ç orlu/Tekirda (TR)

(73) Assignee: Entema Endustriyel Tesisler Ve Makina Sanayi Limited Sirketi, Corlu/Tekirdag (TR)

( * ) Notice: Subject to any disclaimer, the term of this patent is extended or adjusted under 35 U.S.C. 154(b) by 185 days.

(21) Appl. No.: 12/997,739

(22) PCT Filed: May 27, 2009

(86) PCT No.: PCT/TR2009/000068

§ 371 (c)(1),
(2), (4) Date: Dec. 13, 2010

(87) PCT Pub. No.: WO2009/154584

PCT Pub. Date: Dec. 23, 2009

(65) Prior Publication Data

US 2011/0094073 A1 Apr. 28, 2011

(30) Foreign Application Priority Data

Jun. 19, 2008 (TR) ..... 2008/04495

(51) Int. Cl.
*D06C 3/06* (2006.01)
*D06C 19/00* (2006.01)

(52) U.S. Cl.
USPC ..... 26/105; 26/25; 26/51; 26/99

(58) Field of Classification Search ..... 26/105, 26/99, 26, 25, 19, 22, 51, 27, 51.3, 71, 87, 26/101; 492/35, 44, 27, 28
See application file for complete search history.

(56) References Cited

U.S. PATENT DOCUMENTS

| | | | | | |
|---|---|---|---|---|---|
| 657,733 | A | * | 9/1900 | Graves | 19/54 |
| 1,435,712 | A | * | 11/1922 | Livesey | 26/105 |
| 1,563,704 | A | * | 12/1925 | Greis | 26/105 |
| 2,320,891 | A | * | 6/1943 | Ryder, Jr. | 492/36 |
| 2,403,311 | A | * | 7/1946 | Steele | 19/160 |
| 2,488,208 | A | * | 11/1949 | Lederer et al. | 242/364 |
| 2,831,233 | A | * | 4/1958 | Cohn et al. | 26/18.5 |
| 3,308,639 | A | * | 3/1967 | Ziegler et al. | 68/176 |
| 3,885,015 | A | * | 5/1975 | Ono et al. | 264/230 |
| 4,021,894 | A | * | 5/1977 | Poterala et al. | 26/105 |

FOREIGN PATENT DOCUMENTS

| | | | |
|---|---|---|---|
| EP | 0270722 | A | 6/1988 |
| EP | 0708192 | A | 4/1996 |
| EP | 1054093 | A | 11/2000 |

* cited by examiner

*Primary Examiner* — Amy Vanatta
(74) *Attorney, Agent, or Firm* — Egbert Law Offices, PLLC

(57) ABSTRACT

An apparatus for processing a fabric has a drum with an elliptically-shaped cross-section having a pair of narrow sides and a pair of broad sides. Each of the narrow sides have an impact edge. Each of the pair of broad sides has a sliding surface. The drum has a differential helical expander formed on an outer surface thereof. A bearing and drive shaft set are affixed to the drum so as to impact rotational motion to the drum.

3 Claims, 1 Drawing Sheet

ELLIPTICAL-SECTIONED DRUM SYSTEM WITH HELICAL EXPANDER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a drum system with an elliptical cross-section and a helical expander. The drum system is used on textile finishing machines and subjects the processed fabric to beating and expanding actions.

2. Description of Related Art Including Information Disclosed Under 37 CFR 1.97 and 37 CFR 1.98

Some of the drums being used on textile finishing machines have a circular cross-section section and a helical expander structure. They perform an expanding process on the fabric by way of a constant rotating motion, but they do not have an impact effect. Drums, often called beater cylinders, subject the fabric to only a beating motion. They do not have expanding functions. They consist of small diameter cylinders located around a large diameter cylinder and they have beaters in the form of a spinning wheels (consisting of profiles similar to hollow tubes). There are also prior art structures that give volume and touch by subjecting the fabric to blowing and sticking by pneumatic and mechanical mechanisms.

BRIEF SUMMARY OF THE INVENTION

The present invention has an elliptical cross-section drum body and an expanding part wrapped with helically over this body. The expanding part is wrapped from the center to the periphery in a differential manner. While the expanding part performs rotating motion on the machine, to which it is attached, it beats to the fabric by means of the edges on the large diameter (i.e. the principal axis). The frequency and the intensity of the beats are arranged by means of the cycle of the drum and the distance to the fabric. The fabric is expanded to the width and edge folds are eliminated while softening the fabric by beating by means of the helical expanders wrapped on the drum. While the sharp impact edges of the drum softens and expands the fabric by beating, the broad and shallow sliding surfaces prevent the processed fabric from being wrapped to the drum.

Those prior art drums that expand the fabric, by way of the circular cylindrical structures and constant rotating motions, do not have beating effect. The usage of such prior art drums are limited to the expansion of the width of fabric. The beater cylinders cannot perform an expanding function since their structures have only an impact effect. The prior art drums that gain volume and touch effect by means of mechanical and pneumatic mechanisms cannot provide the expansion effect and lead to fractures at the creases of the processed fabric. In the present invention, homogenous and strong beating and expanding effects are created due to the pulse and linear beat effects of the sharp impact edges. The broad and shallow sliding surfaces of the present invention prevent wrapping by slightly contacting the processed fabric that is about to wound wrap around the drum shortly after beating. Moreover, the differential structured helical wrap on the drum allows the fabric to expand to the width, thereby folding and creases are prevented. Since the rotation speeds and distances to the fabric can be adjusted, the intensity of the beating and expanding effect applied to the fabric can be adjusted to a desired level and over-wearing of the fabric is prevented. When fabrics are hard to expand, soften and gain with volume, it is necessary that more impact is applied on those kinds of fabrics so as to process in shorter time. Unlike the prior art other drums, the present invention includes the function of applying both the expanding and the beating effect onto the fabric. As a result, only a single drum is used instead of using separate beater and expanding cylinders. Since the beating and expanding effects are simultaneously applied onto the fabric. The present invention eliminates process residues such as undesired dust and clippings, is enabled.

DETAILED DESCRIPTION OF THE INVENTION

Figure 1:
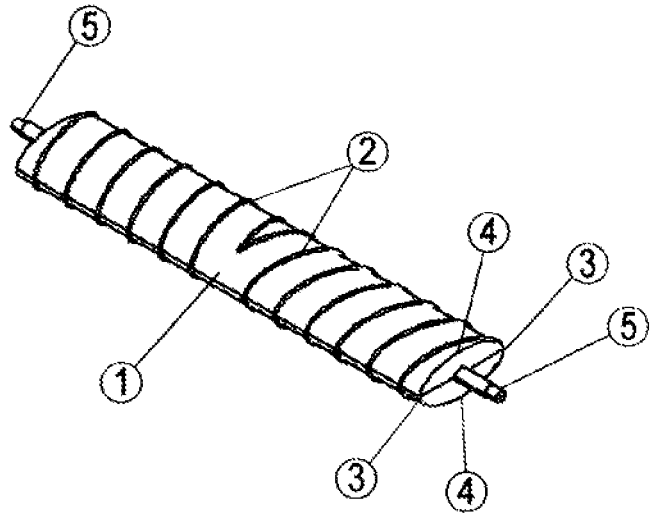
FIG. 1 shows a schematic view of the present invention.
Figure 2:
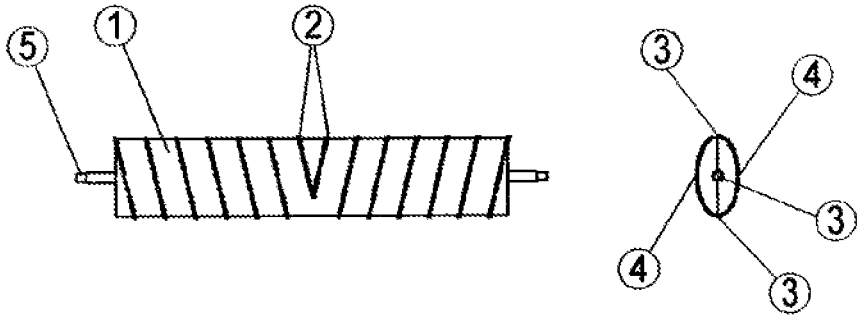
FIG. 2 shows front and side views details of the present invention.

The reference numbers of the parts used and their description are as follows;

1) elliptical drum;

2) differential helical expander;

3) impact edges;

4) broad and shallow sliding surfaces; and

5) bearing and drive shafts.

The differential helical expander (2) enables the fabric to be expanded and prevented from folding. The differential helical expander is positioned on an elliptical cross-section drum (1). The drum (1) is provided with a rotating motion by way of the embedded bearings and associated drive shaft(s). The drum (1) rotates constantly by the driving motion obtained from bearing and drive shafts (5). The elliptical drum (1) performs impact beating by way of impact edges (3) on both narrow sides thereof. In other words, the impact edges (3) facilitate the expanding effect applied to the fabric by the differential helical expander (2) on fabric allows the fabric to be softened and to gain volume. The broad and shallow sliding surfaces (4) located on two other large sides (4) of the elliptical drum (1) prevents contact with the fabric that is about to wrap over elliptical drum (1) by through the beating effect of the impact edges (3). As a result, the wrapping of the fabric around drum (1) is prevented.

We claim:

1. An apparatus for processing a fabric, the apparatus comprising:

a drum having an elliptically-shaped cross section, said drum having an opposed pair of narrow sides and an opposed pair of broad sides, each of said pair of narrow sides being an impact edge, each of said pair of broad sides being a sliding surface, said drum having a differential helical expander formed on an outer surface thereof; and a bearing and drive shaft set affixed to said drum so as to impact rotational motion to said drum.

2. The apparatus of claim 1, the impact edges suitable for a beating effect onto the fabric in generally transverse relationship to the fabric so as to cause said differential helical expander to expand the fabric and to cause the softening and volume-gaining effect on the fabric.

3. The apparatus of claim 1, the sliding surfaces being suitable for contacting the fabric that is about to wrap around said drum as a result of a beating effect of the impact edges on the fabric so as to prevent the fabric from wrapping around the fabric.

* * * * *